US010050393B1

(12) United States Patent
Calabrese

(10) Patent No.: US 10,050,393 B1
(45) Date of Patent: Aug. 14, 2018

(54) MODULAR SOCKET BOX

(71) Applicant: Sony Interactive Entertainment LLC, San Mateo, CA (US)

(72) Inventor: Thomas Calabrese, San Marcos, CA (US)

(73) Assignee: Sony Interactive Entertainment LLC, San Mateo, CA (US)

( * ) Notice: Subject to any disclaimer, the term of this patent is extended or adjusted under 35 U.S.C. 154(b) by 0 days.

(21) Appl. No.: 15/605,081

(22) Filed: May 25, 2017

(51) Int. Cl.
*H01R 25/00* (2006.01)
*H01R 27/00* (2006.01)
*H01R 13/73* (2006.01)
*H01R 13/635* (2006.01)

(52) U.S. Cl.
CPC ..... *H01R 25/006* (2013.01); *H01R 13/635* (2013.01); *H01R 13/73* (2013.01); *H01R 25/00* (2013.01); *H01R 27/00* (2013.01)

(58) Field of Classification Search
CPC ..... H01R 25/006
See application file for complete search history.

(56) References Cited

U.S. PATENT DOCUMENTS 3,707,697 A * 12/1972 Izumi ..... H01R 31/02 340/642
4,918,258 A * 4/1990 Ayer ..... H02G 3/00 174/53
4,958,048 A * 9/1990 Bell ..... H02G 3/125 174/53
5,380,951 A * 1/1995 Comerci ..... H01R 13/74 174/503
6,227,903 B1 * 5/2001 Horton ..... H01R 29/00 439/49
6,485,327 B1 * 11/2002 Morlock ..... H01R 25/003 439/216
6,547,588 B1 * 4/2003 Hsu ..... H01R 13/518 439/532
6,786,766 B1 * 9/2004 Chopra ..... H01R 4/4827 439/441

(Continued)

OTHER PUBLICATIONS

Android Authority, "Swidget is a modular smart home system hidden in your outlets," http://www.androidauthority.com/swidget-modular-smart-home-system-hidden-outlets-793316/; retreived Aug. 16, 2017, 2 pages.

*Primary Examiner* — James Harvey
(74) *Attorney, Agent, or Firm* — Carr & Ferrell LLP

(57) ABSTRACT

A modular electronic apparatus includes an electric box, an insert, and optionally one or more electric modules. The insert is configured to be inserted at least partially into an internal space of the electric box and connect to electric wires of a building. The insert is further configured to receive the electric modules such that they can be powered from the electric wires without directly connecting to them. The electric modules can engage with the insert and be easily replaceable without the need to reconnect the electric wires. Each of the electric modules can be one of the following: a programmable electric socket ("smart" socket), traditional electric socket, programmable electric switch ("smart" switch), traditional electric switch, dimmer, touch screen panel, speaker, personal computer, television device, lighting device, audio player, multimedia device, network hub, a router, and the like.

19 Claims, 6 Drawing Sheets

(56) References Cited

U.S. PATENT DOCUMENTS

| | | | | |
|---|---|---|---|---|
| 6,940,016 | B1 * | 9/2005 | Cornett | H01F 27/06 174/50 |
| 7,160,147 | B1 * | 1/2007 | Stephan | H01R 9/24 174/60 |
| 8,089,032 | B2 * | 1/2012 | Beland | G05D 23/1902 219/492 |
| 9,122,449 | B2 * | 9/2015 | DeSilva | G06F 1/1632 |
| 2008/0219029 | A1 * | 9/2008 | Schoettle | H01R 13/665 362/659 |
| 2009/0101386 | A1 * | 4/2009 | Schoettle | H05K 5/03 174/66 |
| 2012/0110791 | A1 * | 5/2012 | Giemza | F16G 11/106 24/136 R |
| 2013/0252444 | A1 * | 9/2013 | Keswani | H01R 12/7088 439/76.1 |

* cited by examiner

MODULAR SOCKET BOX

BACKGROUND

Technical Field

This disclosure generally relates to modular socket boxes. More particularly, this disclosure relates to a modular electronic apparatus which can be a wall-mounted device for receiving electric modules such as electric outlets, electric sockets, smart sockets, traditional switches, smart switches, and other electric devices.

Description of Related Art

Conventionally, electric sockets are wall-mounted devices that can include an electric box and a socket that is inserted into the electric box. Electric conduits of a building are inserted into the electric box and directly connected to the socket or switch such that electric power can be transmitted to an outer device plugged into the socket. Similarly, an electric switch can be also inserted or installed within the conventional electric box to enable users to turn lighting on or off.

Replacement of an electric socket or switch can be a complicated and annoying task. It requires turning the power off, removing a socket or switch from an electric box, disconnecting the socket or switch from wires, connecting the wires to a new socket or switch, inserting the new socket or switch into the electric box, and turning the power on. Many people find they cannot replace an electric socket themselves and hire a professional electrician. Thus, it makes a difficult task for many individuals to replace traditional sockets with new sockets such as smart sockets (or smart switches).

SUMMARY

This section is provided to introduce a selection of aspects and concepts in a simplified form that are further described below in the Detailed Description section. This summary is not intended to identify key features or essential features of the claimed subject matter, nor is it intended to be used as an aid in determining the scope of the claimed subject matter. The following aspects and concepts of this disclosure are designed to solve at least some drawbacks known in the art.

In one aspect of this disclosure, there is provided a modular electronic apparatus comprising: an electric box for securing to a wall, a floor, or a ceiling of a building, with the electric box including a first internal space; an insert configured to be inserted at least partially to the internal space of the electric box, with the insert including electric inputs to an electric power, and the insert including a second internal space; and one or more electric modules configured to be powered by at least a part of the electric power; wherein the insert is further configured to receive the one or more electric modules into the second internal space and provide an electric connection between at least one of the electric inputs and each of the electric modules.

In certain embodiments, at least one of the electric modules is a programmable electric socket configured to wirelessly receive commands from a mobile device and adjust operation based on the commands. In yet additional embodiments, each of the electric modules can be selected from an electric outlet, an electric switch, a touch screen panel, a speaker, a personal computer, a lighting device, an audio player, and the like. In some embodiments, the insert is configured to receive and hold two or more electric modules, wherein the two or more electric modules are configured to be directly mounted to one another. In some embodiments, the insert further includes two or more contact points facing inside the second internal space, wherein the two or more contact points are configured to engage with contacts of the one or more electric modules to transmit the electric power.

In some embodiments, the contacts of the one or more electric modules are arranged on a back wall facing a back wall the insert. In some embodiments, each of the electric modules includes at least one slot for engaging with a sliding profile connector of another electric module or a sliding profile connector of the insert; and at least one sliding profile connector for engaging with a slot of another electric module or a slot of the insert. In additional embodiments, the insert further includes at least one slot for engaging with a sliding profile connector of one of the electric modules and at least one sliding profile connector for engaging with a slot of one of the electric modules. In some embodiments, the insert includes one or more buttons, each of which is configured to release a wire connected to one of the electric inputs, wherein the one or more buttons are arranged on a back wall of the insert, with the back wall facing the first internal space.

In some embodiments, each of electric modules includes one or more movable spring-loaded pins for engaging with the insert; and a button, which when pressed by a user, causes the one or more movable spring-loaded pins to disengage from the insert.

In another aspect of this disclosure, there is provided a modular electronic apparatus, comprising an electric box for securing to a wall, a floor, or a ceiling of a building, the electric box including a first internal space; an insert configured to be inserted at least partially into the internal space of the electric box, with the insert including electric inputs to an electric power, and the insert including a second internal space, wherein the insert is further configured to receive one or more electric modules into the second internal space and provide an electric connection between at least one of the electric inputs and each of the electric modules, wherein each of the one or more electric modules is configured to engage with the insert using at least one sliding profile connector and at least one slot.

In some embodiments, each of the electric modules includes at least one slot for engaging with a sliding profile connector of another electric module or a sliding profile connector of the insert; and at least one sliding profile connector for engaging with a slot of another electric module or a slot of the insert. In some embodiments, the insert further includes at least one slot for engaging with a sliding profile connector of one of the electric modules and at least one sliding profile connector for engaging with a slot of one of the electric modules.

Additional objects, advantages, and novel features of the examples will be set forth in part in the description, which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

Embodiments are illustrated by way of example and not limitation in the figures of the accompanying drawings, in which like references indicate similar elements.

Figure 1:
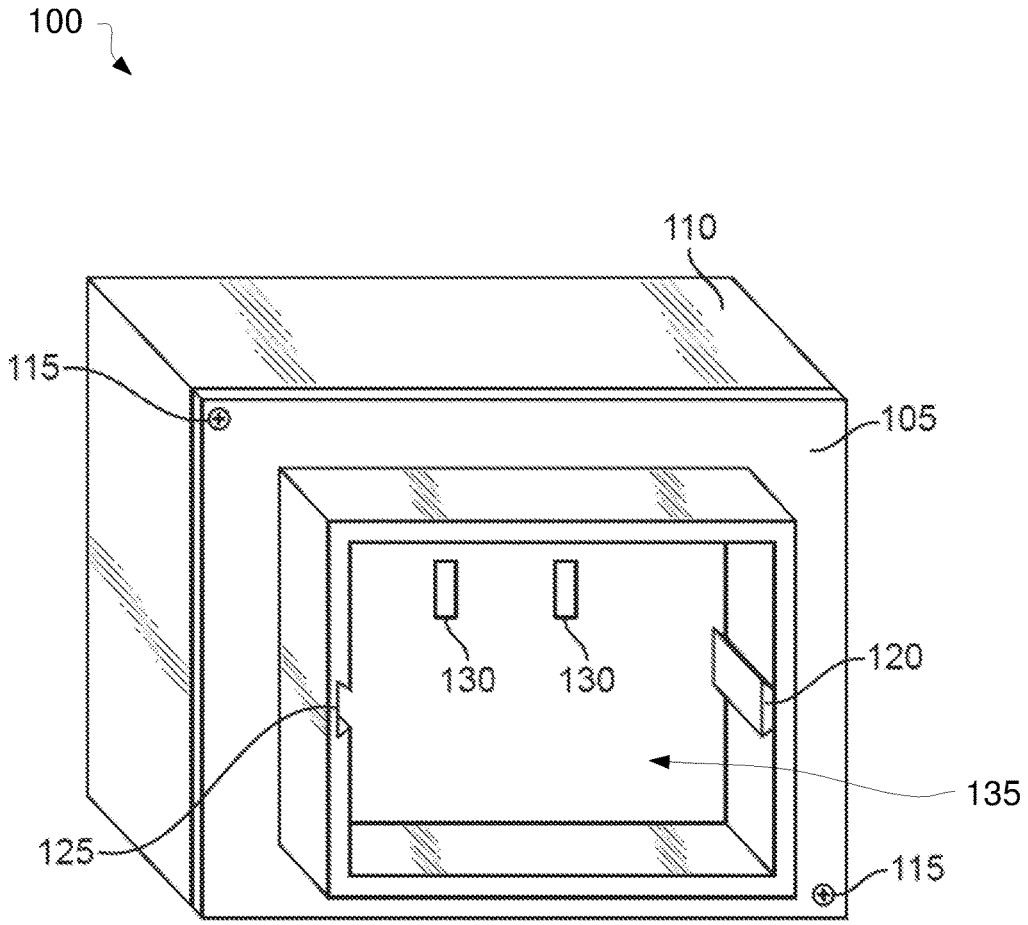
FIG. 1 shows a perspective view of a modular electronic apparatus.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. In addition, common but well-understood elements that are useful or necessary in a commercially feasible embodiment are often not depicted in order to facilitate a less obstructed view of these various embodiments of the present disclosure.

DETAILED DESCRIPTION OF EXEMPLARY EMBODIMENTS

The present disclosure generally relates to a modular socket box, which is also referred herein to as a modular electronic apparatus (these terms can be used interchangeably). The modular electronic apparatus is designed to simplify the process of replacing, changing, installing, or re-installing electric modules, such as electric sockets or switches, without the need to directly connect these electric modules to electric wires of a building.

Generally speaking, according to various embodiments of this disclosure, the modular electronic apparatus includes an electric box, an insert, and, optionally, one or more electric modules. The electric box can be designed to be built-in, installed, secured, or otherwise connected to a wall, a floor, or a ceiling of a building. The electric box can have a substantially rectangular prism or cuboid design and include a hollow internal space. The electric box can include one or more openings to let one or more electric wires of the building inside the electric box.

The insert is configured to be inserted into the electric box and be connected to the electric wires of the building. The insert can be substantially of a rectangular prism or cuboid design such that the insert includes a hollow internal space. In some embodiments, the insert can be installed or inserted in the electric box such that it remains non-movable or fixed within the internal space of the electric box. In other embodiments, the insert remains fixed in the electric box after installment. The insert can include one or more electric contacts arranged on a back wall such that the electric contacts (e.g., pins or terminals) face the internal space of the insert. The insert can also include internal conductors operatively connecting the electric wires of the building with the electric contacts of the insert.

The electric modules can be inserted, installed, or otherwise engaged inside the insert in a removable manner. In some embodiments, the insert can receive only one electric module. In other embodiments, the insert can receive two or more electric modules. When inserted, each of the electric modules comes into electric contact with the electric contacts of the insert. Thus, there is no need for the electric modules to be connected directly to the electric wires of the building in order to be powered.

Each of the electric modules can be one of the following: a programmable electric socket ("smart" socket), a traditional electric socket, a programmable electric switch ("smart" switch), a traditional electric switch, a dimmer, an intercom, a telephone, a cell phone docking station, a telephone base station, a security camera, a touch screen panel, a speaker, a wireless speaker, a personal computer, a computing device, a lighting device, a lamp, a Light-Emitting Diode (LED) lighting device, an audio player, a multimedia device, a display, a game console, a gaming device, a game controller, a network device, a network hub, a modem, a network router, a Universal Serial Bus (USB) port, a device with High-Definition Multimedia Interface (HDMI) port, a device with a video output port, a device with Ethernet port, a set-top box, a television (TV) device, a "smart" television device, and the like.

The electric modules can be easily installed or inserted into the insert by snapping into the insert. The electric modules can be also easily replaced or changed by removing them from the insert and inserting new ones. Each electric module can mechanically engage, mount, connect, or otherwise couple to the insert. For these ends, each electric module can include spring-loaded pins that can protrude (for example, into one of openings of the insert). There can be provided a button on a front wall of each electric module, which when pressed by a user, causes the spring-loaded pins to move inside the electric module and disengage from the openings of the insert so that the electric modules can be removed from the insert. Each of the electric modules can also include at least one slot for engaging with a sliding profile connector of the insert. Each of the electric modules can also include at least one sliding profile connector for engaging with a slot of the insert. Similarly, two or more electric modules can be mechanically connected to one another by engaging at least one sliding profile connector of the electric module with at least one of slots of another electric module. At the same time, these two or more electric modules remain independent devices as they may not be operatively connected with one another.

Thus, the embodiments of present disclosure facilitate installation and use of various electric modules at homes, offices, or any other buildings. For example, users can install speakers at various places at home by snapping the speakers into available inserts of built-in modular electricity apparatuses. The speakers can be wirelessly programmed by a mobile device to output same sounds or music as wirelessly received from the mobile device or another electronic device such as a TV device or multimedia system.

In another example, the users can install electric sockets (made in the form of electric modules) of a required type. For example, if a user needs to use a European Type C socket instead of a Type A socket, which is common in the United States, the user may simply remove one of the electric modules from the insert in one of the modular electricity apparatus and insert a new electric module in the form of electric socket of Type C. Similarly, sockets of any international standard, including sockets of any Type A through Type O, can be used.

In yet another example, the user can arrange various electronic devices of his interest in desired locations at home by simply installing respective electric modules in modular socket boxes of his interest. The user can install an intercom in one location, a dimmer in another location, a light switch in yet another location, and so forth. Thus, this technology simplifies the creation of a "smart home" and replacement of sockets or other electric modules by a general public without the need to hire a professional electrician.

The following detailed description of embodiments includes references to the accompanying drawings, which form a part of the detailed description. Approaches described in this section are not prior art to the claims and are not admitted to be prior art by inclusion in this section. Reference throughout this specification to "one embodiment," "an embodiment," "some embodiments," "some implementations," or similar language means that a particular feature, structure, or characteristic described in connection with an example implementation is included in at least one embodiment of the present disclosure. Thus, appearances of the phrases "in one embodiment," "in an embodiment," "in some embodiments," and similar language throughout this specification may, but do not necessarily, all refer to the same embodiment.

For purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

Moreover, it shall be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," and so forth). Spatially relative terms, such as "beneath," "below," "lower," "above," "upper" and the like may be used to describe an element or feature's relationship to another element(s) and/or feature(s) as, for example, illustrated in the drawings.

The term "electric module" shall be construed to mean an electric device, including, but not limited to, a programmable electric socket ("smart" socket), a traditional electric socket, a programmable electric switch ("smart" switch), a traditional electric switch, a dimmer, an intercom, a telephone, a cell phone docking station, a telephone base station, a security camera, a video camera, a communication device, a touch screen panel, a display, a monitor, a speaker, a wireless speaker, a personal computer, a computing device, a lighting device, a lamp, an LED lighting device, an audio player, a multimedia device, a display, a game console, a gaming device, a game controller, a network device, a network hub, a modem, a network router, a device with one or more USB ports, a device with one or more HDMI ports, a device with a video output port, a device with Ethernet port, a set-top box, a television device, and a "smart" television device.

Now, exemplary embodiments are described with reference to the drawings. The drawings are schematic illustrations of idealized example embodiments. As such, variations from the shapes of the illustrations as a result, for example, of manufacturing techniques or tolerances, are to be expected. Thus, example embodiments discussed herein should not be construed as limited to the particular shapes of regions illustrated herein but are to include deviations in shapes that result, for example, from manufacturing.

FIG. 1 shows a perspective view of a modular electronic apparatus 100, according to one example embodiment. Modular electronic apparatus 100 includes an insert 105 and an electric box 110. Each of insert 105 and electric box 110 can be manufactured of a polymer material, resin, plastic, metal, or any combination thereof. Electric box 110 generally has a cuboid shape, although other shapes can be also applicable, such as a cylindrical shape. Electric box 110 is designed to be mounted, inserted, secured, or otherwise connected to a part of a building such as a wall, a floor, or a ceiling of the building. Electric box 110 can include one or more through openings to let one or more electric wires or power lines of the building inside of electric box 110 such that the electric wires or power lines become inside an internal space of electric box 110.

Insert 105 can be manufactured of a polymer material, resin, plastic, metal, or any combination thereof. Insert 105 generally has a cuboid shape, although other shapes can be also applicable, such as a cylindrical shape. Dimensions of insert 105 are smaller than dimensions of electric box 110 to enable insert 105 be inserted, at least partially, into the internal space of electric box 110. In some embodiments, insert 105 can be fixed to electric box 110, for example, using one or more screws 115, bolts, snap locks, or any other suitable connecting means. In other embodiments, insert 105 can be connected to electric box 110 and remain fixed. For example, insert 105 can be connected to electric box 110 using one or more pivots or bearings such as to provide some degree of freedom so as to enable rotating or moving insert 105 inside electric box 110 in one or more predetermined directions.

Figure 3:
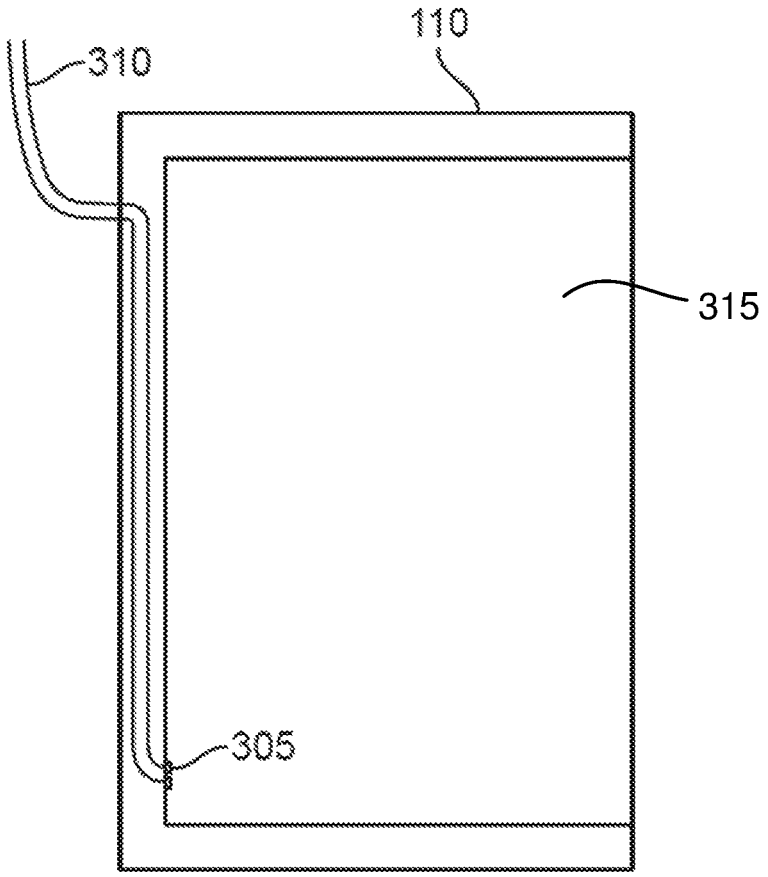
FIG. 3 shows a cross-section view of an electric box.

The electric wires or power lines of the building, which are provided inside the internal space of electric box 110, can be connected to one or more inputs, ports, or other connectors as shown in FIG. 3 and explained below. Insert 105 can also include one or more contacts 130 (i.e., terminals, ports, pins, or other connectors configured to transmit an electric signal or electric power). Contacts 130 can be provided on a back wall of insert 105 so that contacts 130 face an internal space 135 of insert 105. Contacts 130 are configured to engage with corresponding contacts (or ports, pins, terminals) of electric modules such as contacts 605 of electric modules as described below with reference to FIG. 6.

Insert 105 is generally adapted to receive one or more electric modules such as electric modules 405 shown in FIG. 4 and described below. In certain embodiments, insert 105 can also include one or more slots 120, where each of slots 120 is designed to be engaged with a sliding profile connector 410 of electric module 405 as described below with reference to FIG. 4. Insert 105 can also include one or more sliding profile connectors 125, where each of sliding profile connector 125 is designed to be engaged with a slot 415 of electric module 405 as described below with reference to FIG. 4. In one example, a cross-section of slot 120 can be tapered or of T-shape. Similarly, a cross-section of sliding profile connector 125 can be tapered or of a T-shape. As shown in FIG. 1, both slot 120 and sliding profile connector 125 can be arranged opposite to one another, but not necessarily. Further, both slot 120 and sliding profile connector 125 can be provided on side walls of insert 105 such that both slot 120 and sliding profile connector 125 face internal space 135 of insert 105.

Figure 2:
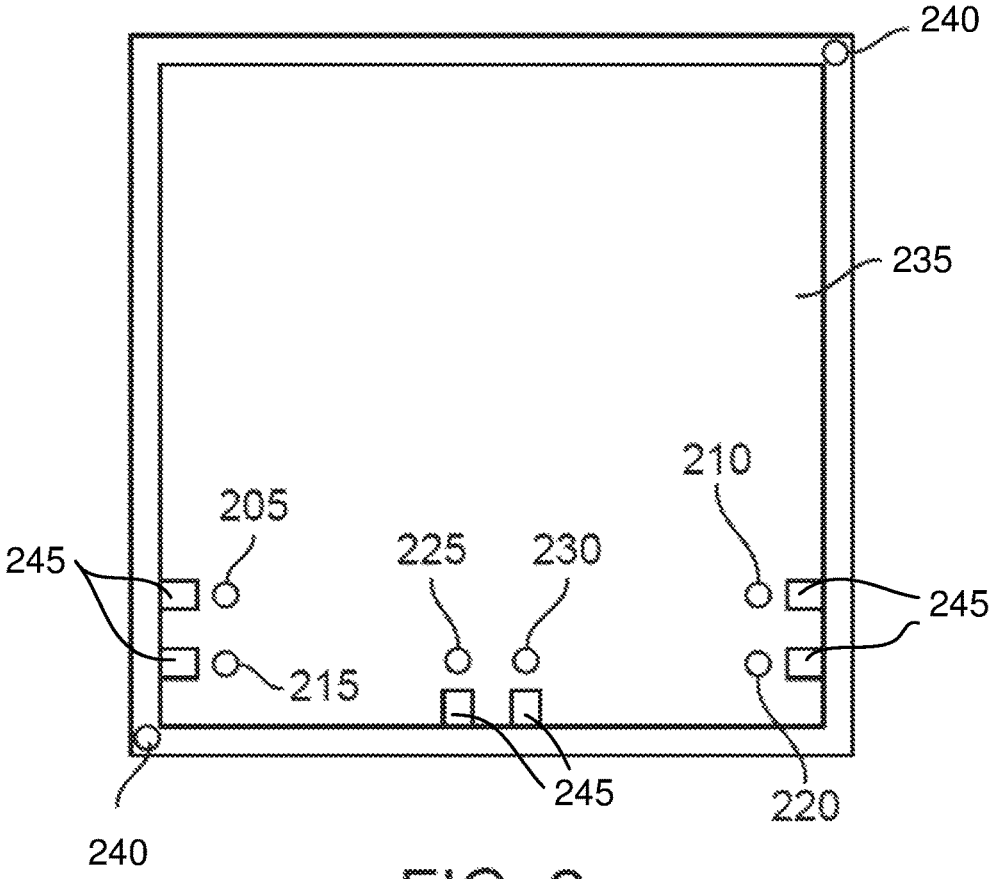
FIG. 2 shows a back side of an insert.

FIG. 2 shows a back side of insert 105, according to one example embodiment. As shown in this figure, insert 105 includes a back wall 235, which faces the internal space of electric box 110 when insert 105 is inserted into electric box 110. Insert 105 also includes one or more openings 240 for screws 115. Further, back wall 235 of insert 105 can include a number of openings, contacts, terminals, pins, or other connectors (collectively referred to as "electric inputs") for operatively coupling with one or more of the electric wires of the building. Particularly, there can be provided a hot in electric input 225 and a hot out electric input 230 such as for receiving Alternating Current (AC) electric signal. There can be also provided an electric input 215 and an electric input 220 for connecting to Earth ground and/or electric neutral phase, respectively. There can be also provided an electric input 205 and an electric input 210 for receiving a switching or control signal. Insert 105 can also include one or more buttons 245, which when pressed by a user, cause disengaging an electric wire from a respective electric inputs and outputs 205-230.

FIG. 3 shows a cross-section view of electric box 110, according to one example embodiment. As discussed above, electric box 110 can have a hollow cuboid shape such that electric box 110 includes an internal space 315. Internal space 315 is suitable for receiving insert 105. Internal space 315 can be shaped such that only a part of insert 105 can be arranged within internal space 315. In other embodiments, internal space 315 can be shaped and have such dimensions that the whole insert 105 can be arranged within internal space 315. In some embodiments, insert 105 can be non-movably fixed to electric box 110. In other embodiments, insert 105 can remain movable within electric box 110.

Electric wires 310, such as power lines, can be arranged through electric box 110. For example, electric box 110 can include openings for letting electric wires 310 through electric box 110 such that some parts 305 of electric wires 310 are arranged within internal space 315. Parts 305 of electric wires 310 can be connected to one or more electric inputs and outputs 205-230 of insert 105. In some embodiments, one or more parts 305 of electric wires 310 constitute one or more electric terminals, plugs, sockets, connectors, ports, terminals, or pins.

Figure 4:
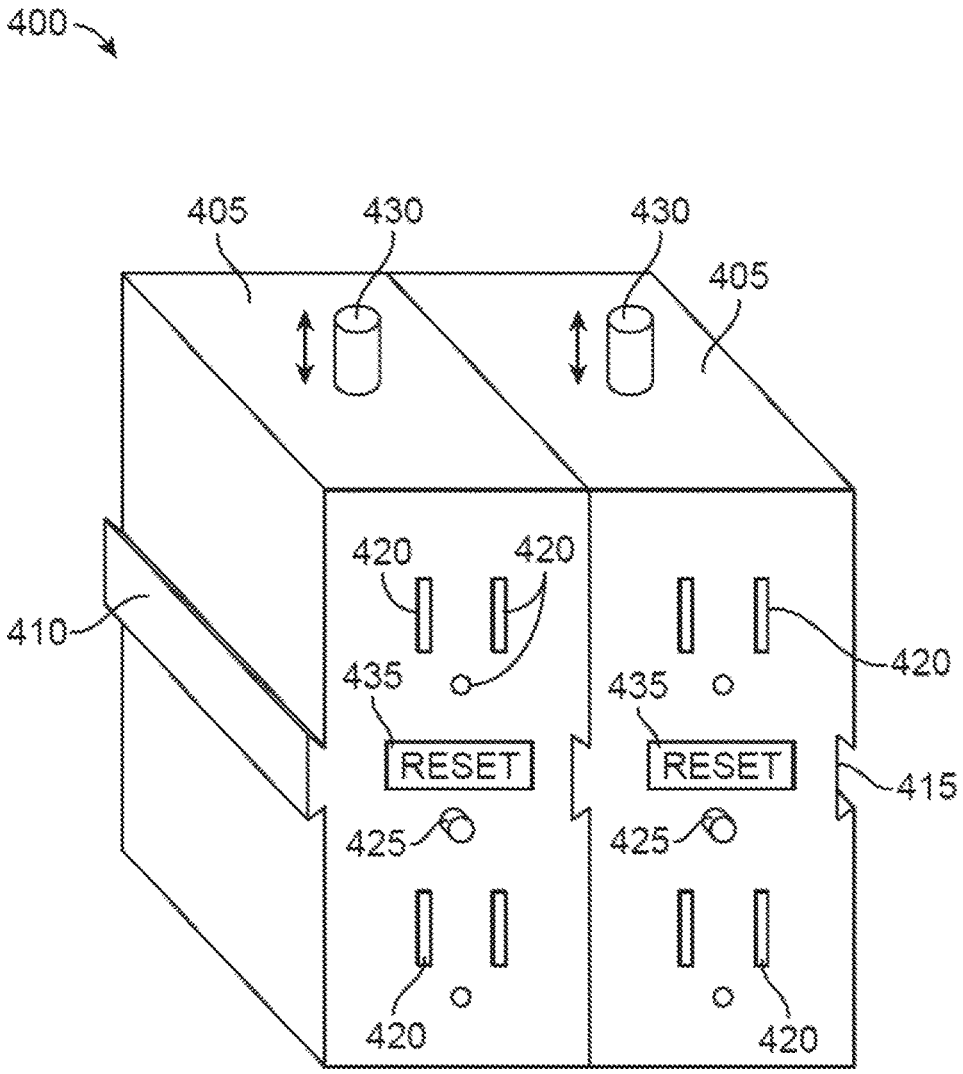
FIG. 4 shows a perspective view of two electric modules coupled to one another.
Figure 5:
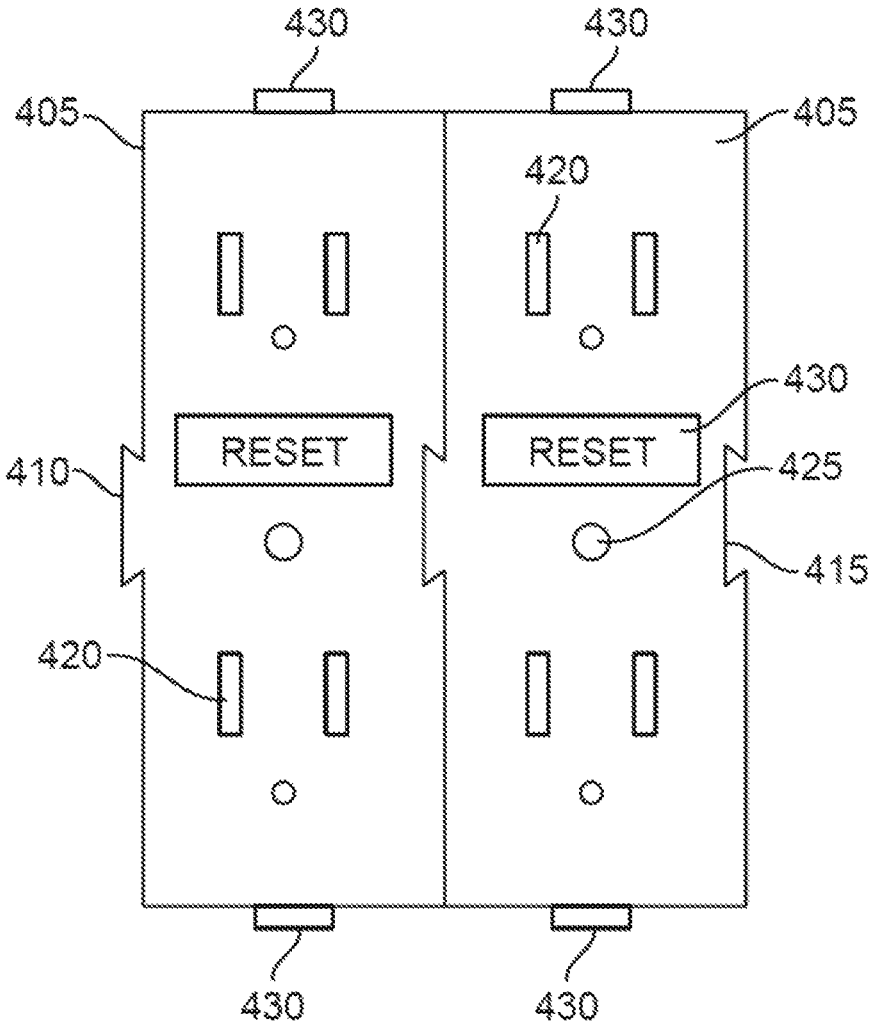
FIG. 5 shows a front view of two electric modules coupled to one another.
Figure 6:
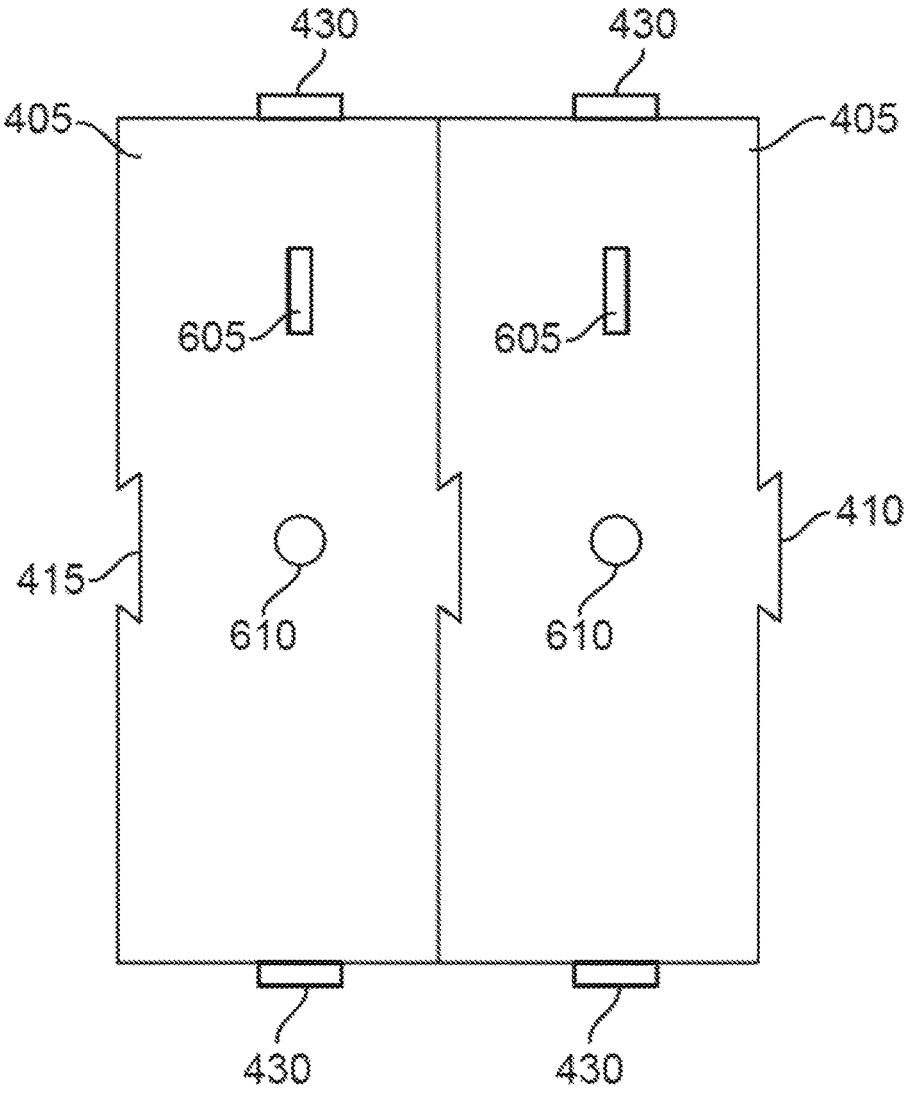
FIG. 6 shows a back view of two electric modules coupled to one another.

FIG. 4 shows a perspective view 400 of two electric modules 405 coupled to one another, according to one example embodiment. FIG. 5 shows a front view of two electric modules 405 coupled to one another, according to one example embodiment. FIG. 6 shows a back view of two electric modules 405 coupled to one another, according to one example embodiment. FIGS. 4-6 show that each of electric modules 405 is a double electric socket; however, as discussed above, each of electric modules 405 can be a different electric device, including, for example, an electric switch, speaker, dimmer, intercom, and so forth.

As shown in FIGS. 4-6, each of electric modules 405 includes one or more slots 415, where each of slots 415 is designed to be engaged with sliding profile connector 410 of another electric module 405 or sliding profile connector 125 of insert 105. Further, each of electric modules 405 includes one or more sliding profile connectors 410, where each of sliding profile connectors 410 is designed to be engaged with slot 415 of another electric module 405 or slot 120 of insert 105. A cross-section of slot 415 can be tapered or of a T-shape. Similarly, a cross-section of sliding profile connector 410 can be tapered or of a T-shape. In addition, both slot 415 and sliding profile connector 410 can be arranged opposite to one another, but not necessarily. Further, both slot 415 and sliding profile connector 410 can be provided on side walls of each electric module 405.

Still referring to FIGS. 4-6, each of electric modules 405 includes socket openings 420 for receiving one or more electric plugs. Each of electric modules 405 can also include a "Reset" button 435 and a corresponding breaker circuit inside electric module 405 connected to "Reset" button 435.

Each of electric modules 405 includes spring-loaded pins 430, 610 that can be configured to protrude outside of electric module 405 and to insert into electric module 405. Thus, spring-loaded pins 430, 610 can be a retractable device and actuated by a button 425. Spring-loaded pins 430, 610 can be constrained and inserted inside electric module 405 upon a press on button 425. Location of spring-loaded pins 430, 610 can be arbitrary; however, in the embodiment shown, a first spring-loaded pin 430 is configured to move perpendicular to a top wall of electric module 405, a second spring-loaded pin 430 is configured to move perpendicular to a bottom wall of electric module 405, and a third spring-loaded pin 610 is configured to move perpendicular to a back wall of electric module 405.

In some embodiments, insert 105 can include one or more openings facing internal space 135 and configured to receive spring-loaded pins 430. Thus, when a particular electric module 405 is inserted into insert 105, spring-loaded pins 430 protrude into the openings of insert 105 to engage with insert 105 and keep electric module 405 securely fixed to insert 105. However, when the user presses button 425, spring-loaded pins 430 disengage from these openings and the whole electric module 405 becomes disengaged from insert 105. The movement of spring-loaded pin 610 helps to move the whole electric module 405 from insert 105.

With reference to FIG. 6, each of electric modules 405 include one or more contacts 605 (or ports, pins, terminals) for coupling to contacts 130 of insert 105 such that electric power or other electric signals of electric wires 310 can be transmitted to electronics of electric modules 405.

Thus, aspects and embodiments of modular electricity apparatuses have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. A modular electronic apparatus, comprising:

an electric box for securing to a wall, a floor, or a ceiling of a building, the electric box including a first internal space;

an insert configured to be inserted at least partially into the first internal space of the electric box, the insert including electric inputs to an electric power, and the insert including a second internal space; and one or more electric modules configured to be powered by at least a part of the electric power, wherein each of the one or more electric modules includes:

one or more movable spring-loaded pins for engaging with the insert; and a button, which when pressed by a user, causes the one or more movable spring-loaded pins to disengage from the insert;

wherein the insert is further configured to receive the one or more electric modules into the second internal space and provide an electric connection between at least one of the electric inputs and each of the one or more electric modules.

2. The apparatus of claim 1, wherein at least one of the one or more electric modules is a programmable electric socket configured to wirelessly receive commands from a mobile device and adjust operation based on the commands.

3. The apparatus of claim 1, wherein at least one of the one or more electric modules is an electric outlet.

4. The apparatus of claim 1, wherein at least one of the one or more electric modules is an electric switch.

5. The apparatus of claim 1, wherein at least one of the one or more electric modules is a touch screen panel.

6. The apparatus of claim 1, wherein at least one of the one or more electric modules is a speaker.

7. The apparatus of claim 1, wherein at least one of the one or more electric modules is a personal computer.

8. The apparatus of claim 1, wherein at least one of the one or more electric modules is a lighting device.

9. The apparatus of claim 1, wherein at least one of the one or more electric modules is an audio player.

10. The apparatus of claim 1, wherein the insert is configured to receive and hold two or more electric modules, wherein the two or more electric modules are configured to be directly mounted to one another.

11. The apparatus of claim 1, wherein the insert further includes two or more contact points facing inside the second internal space, wherein the two or more contact points are configured to engage with contacts of the one or more electric modules to transmit the electric power.

12. The apparatus of claim 11, wherein the contacts of the one or more electric modules are arranged on a back wall facing a back wall of the insert.

13. The apparatus of claim 1, wherein each of the one or more electric modules includes:

at least one slot for engaging with a sliding profile connector of another electric module or a sliding profile connector of the insert; and at least one sliding profile connector for engaging with a slot of another electric module or a slot of the insert.

14. The apparatus of claim 1, wherein the insert further includes:

at least one slot for engaging with a sliding profile connector of one of the electric modules; and at least one sliding profile connector for engaging with a slot of one of the electric modules.

15. The apparatus of claim 1, wherein the insert includes one or more buttons, each of which is configured to release a wire connected to one of the electric inputs, wherein the one or more buttons are arranged on a back wall of the insert, the back wall facing the first internal space.

16. An electric module, comprising:

one or more movable spring-loaded pins for engaging with an insert, the insert being configured to be inserted at least partially into a first internal space of an electric box, the electric box for securing to a wall, a floor, or a ceiling of a building, the insert including electric inputs to an electric power, and the insert including a second internal space, the insert being also configured to receive the electric module into the second internal space and provide an electric connection between at least one of the electric inputs and the electric module, wherein the electric module is configured to be powered by at least a part of the electric power; and a button, which when pressed by a user, causes the one or more movable spring-loaded pins to disengage from the insert.

17. A modular electronic apparatus, comprising:

an electric box for securing to a wall, a floor, or a ceiling of a building, the electric box including a first internal space; and an insert configured to be inserted at least partially into the first internal space of the electric box, the insert including electric inputs to an electric power, and the insert including a second internal space, wherein the insert is further configured to receive one or more electric modules into the second internal space and provide an electric connection between at least one of the electric inputs and each of the one or more electric modules, wherein each of the one or more electric modules is configured to engage with the insert using at least one sliding profile connector and at least one slot, each of the one or more electric modules including one or more movable spring-loaded pins for engaging with the insert, and including a button, which when pressed by a user, causes the one or more movable spring-loaded pins to disengage from the insert.

18. The apparatus of claim 17, wherein each of the one or more electric modules includes:

at least one slot for engaging with a sliding profile connector of another electric module or a sliding profile connector of the insert; and at least one sliding profile connector for engaging with a slot of another electric module or a slot of the insert.

19. The apparatus of claim 17, wherein the insert further includes:

at least one slot for engaging with a sliding profile connector of one of the electric modules; and at least one sliding profile connector for engaging with a slot of one of the electric modules.

* * * * *